US009692144B1

(12) United States Patent
Hung

(10) Patent No.: US 9,692,144 B1
(45) Date of Patent: Jun. 27, 2017

(54) ELECTRIC CONNECTOR

(71) Applicants: KUNSHAN AMPHENOL ZHENGRI ELECTRONICS CO., LTD., Kunshan, Jiangsu Province (CN); Amphenol LTW Technology Co., Ltd., New Taipei (TW)

(72) Inventor: Jen-Yuan Hung, New Taipei (TW)

(73) Assignees: KUNSHAN AMPHENOL ZHENGRI ELECTRONICS CO., LTD., Kunshan, Jiangsu Province (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/401,059

(22) Filed: Jan. 8, 2017

(30) Foreign Application Priority Data

Nov. 24, 2016 (TW) ..... 105217970 U

(51) Int. Cl.
*H01R 4/38* (2006.01)
*H01R 4/24* (2006.01)
*H01R 13/512* (2006.01)

(52) U.S. Cl.
CPC ..... *H01R 4/2433* (2013.01); *H01R 13/512* (2013.01)

(58) Field of Classification Search
CPC ..... H01R 13/622; H01R 9/0521; F21S 6/00
USPC ..... 439/320, 322, 323, 312, 313
See application file for complete search history.

(56) References Cited

U.S. PATENT DOCUMENTS 6,135,800 A * 10/2000 Majors ..... H01R 13/622 439/321
6,957,972 B2 * 10/2005 Starke ..... H01R 13/625 439/216
7,682,177 B2 * 3/2010 Berthet ..... H01R 13/622 439/321
8,192,218 B2 * 6/2012 Sasaki ..... H01R 13/623 439/320
9,419,374 B2 * 8/2016 Umbach ..... H01R 13/622

* cited by examiner

*Primary Examiner* — Phuongchi T Nguyen
(74) *Attorney, Agent, or Firm* — Chun-Ming Shih; HDLS IPR Services

(57) ABSTRACT

An electric connector (10) includes a first connector seat (1) and a second connector seat (2). The first connector seat (1) has plural cable clamps (11), and each cable clamp (11) includes a pair of U-shaped rods (12). Each pair of U-shaped rods (12) has a pocket (121), two inner sides (122), and two outer sides (123). The two inner sides (122) have plural cable fixing slots (124), and the cable fixing slots (124) have a slot width (h) tapered towards the first connector seat (1). The second connector seat (2) has plural pins (21), and each pin (21) is passed and coupled to each pocket (121).

7 Claims, 9 Drawing Sheets

ELECTRIC CONNECTOR

FIELD OF THE INVENTION

This disclosure relates to an electric connector, and more particularly to an electric connector for outputting, inputting, or transmitting electric power or electric signals.

BACKGROUND OF THE INVENTION

With reference to FIG. 1 for a conventional electric connector, the electric connector comprises a first joint cylinder a1, a second joint cylinder b1, a plurality of first cables, and a plurality of second cables, and the first joint cylinder a1 has a plurality of jacks a2, and the core wire in each first cable is soldered and connected, and a thread is provided for locking and crimping to connect the cables and pins to each jack a2, and the second joint cylinder b1 has a plurality of pins b2, and each pin b2 is soldered and connected, and a thread is provided for locking and crimping to electrically connect each second cable. Wherein, the first joint cylinder a1 and the second joint cylinder b1 are connected with each other, and each first cable is inserted into each jack a2, and then the pins b2 are soldered and connected, and a thread is provided for locking and crimping to contact the core wire of each first cable, so that each first cable and each second cable are connected to complete the finished product of the electric connector.

However, the aforementioned electric connector has the following drawbacks: The pin b2 is connected to the cable mainly by soldering, and the thread provided for locking and crimping takes much time and effort and requires tools for operation, and such electric connector is just applicable for connecting a cable of a specific wire diameter to fit the width of the slot. As a result, manufacturers have to carry pins of various different sizes and limit the size of the cable, and thus incurring a higher cost of the electric connector and resulting in a large inventory of the pins b2 of various different sizes.

In view of the aforementioned drawbacks of the prior art, the discloser of this disclosure based on years of experience in the related industry to conduct extensive research, and finally developed an electric connector according to this disclosure applicable for different wire diameters and requiring no hand tool for its installation.

SUMMARY OF THE INVENTION

Therefore, it is a primary objective of the present invention to provide an electric connector having a plurality of cable fixing slots inwardly formed on two inner sides of each pair of U-shaped rods, and the width of the plurality of cable fixing slots is tapered in a direction towards a first connector seat, so that the first connector seat fits various cables with different wire diameters, and the electric connector of this disclosure has the advantages of saving cost and extending the range of installation.

To achieve the aforementioned and other objectives, this disclosure provides an electric connector used for a plurality of first cables and a plurality of second cables, and the first cable having a core wire and an insulating layer, and the electric connector comprising: a first connector seat, having a plurality of cable clamps, each including a pair of U-shaped rods extended from the first connector seat, and each pair of U-shaped rods having a pocket formed on an inner side of the pair of U-shaped rods, and both two inner sides and outer side having two outer sides, and the two inner sides jointly having a plurality of cable fixing slots inwardly formed on and penetrating through the two outer sides, and the plurality of cable fixing slots having a slot width tapered in a direction towards the first connector seat, and each of the first cables being clamped between each pair of U-shaped rods and latched to one of the cable fixing slots; and a second connector seat, having a plurality of pins electrically coupled to each of the second cables, and each pin being passed and coupled to each pocket and piercing each insulating layer, such that each pin is electrically coupled to each respective core wire.

Wherein, each pin has a U-shaped insert, and the two blades of the U-shaped insert is designed tapered outwardly, so that the U-shaped insert can fit various first cables with different external diameters.

Wherein, when each U-shaped insert is passed and coupled to each pocket, spacing exists between the two second inclined surfaces of each pair of U-shaped rods. Since the spacing adjacent to the first connector seat is greater than the width of the U-shaped insert, so that when the U-shaped insert cuts into the insulating layer, the insert has not been stopped by the second inclined surface, and the electric connector is capable of controlling the width between the two blades of the U-shaped insert and controlling the amount of deformation of the two blades.

Wherein, when each U-shaped insert is passed and coupled to each pocket, spacing exists between the two second inclined surfaces of each pair of U-shaped rods. Since the spacing away from the first connector seat is greater than the width of the U-shaped insert 211, and just the end section of each of the two second inclined surfaces can stop each U-shaped insert to prevent the U-shaped insert from being deformed too much or having a plastic deformation, so that the electric connector is applicable for various first cable with different wire diameters and capable of ensuring product stability.

DESCRIPTION OF THE PREFERRED EMBODIMENTS

Figure 1:
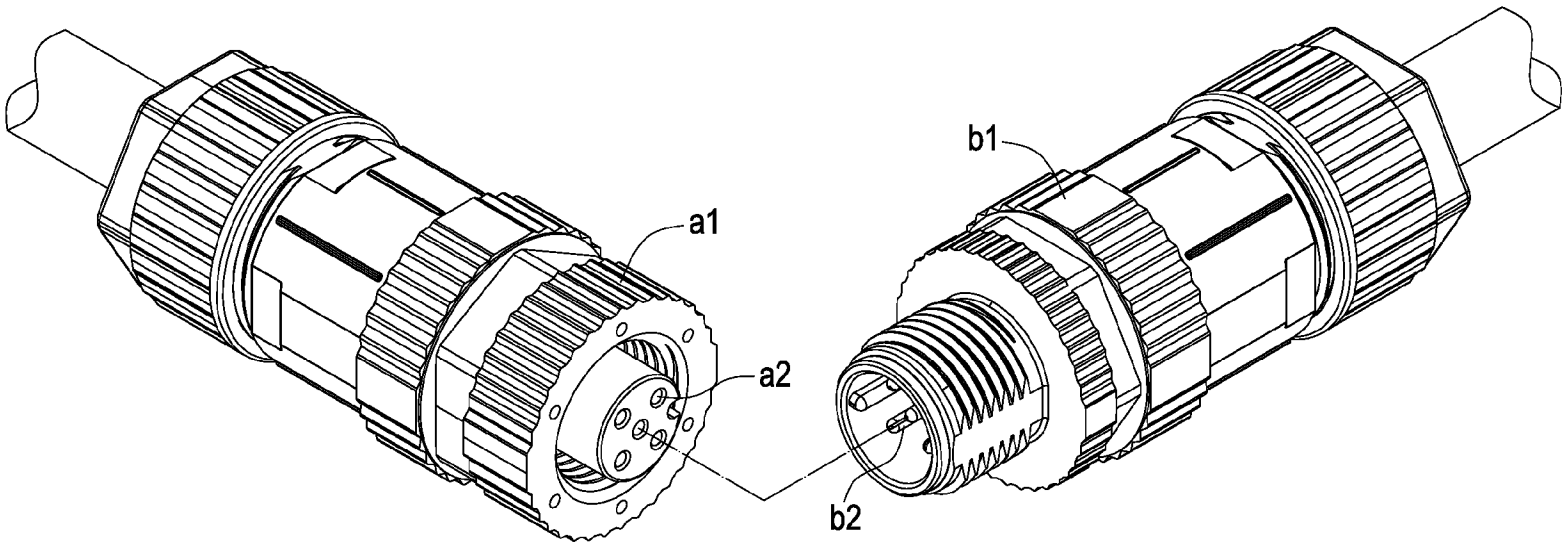
FIG. 1 is an exploded view of a conventional electric connector.
Figure 2:
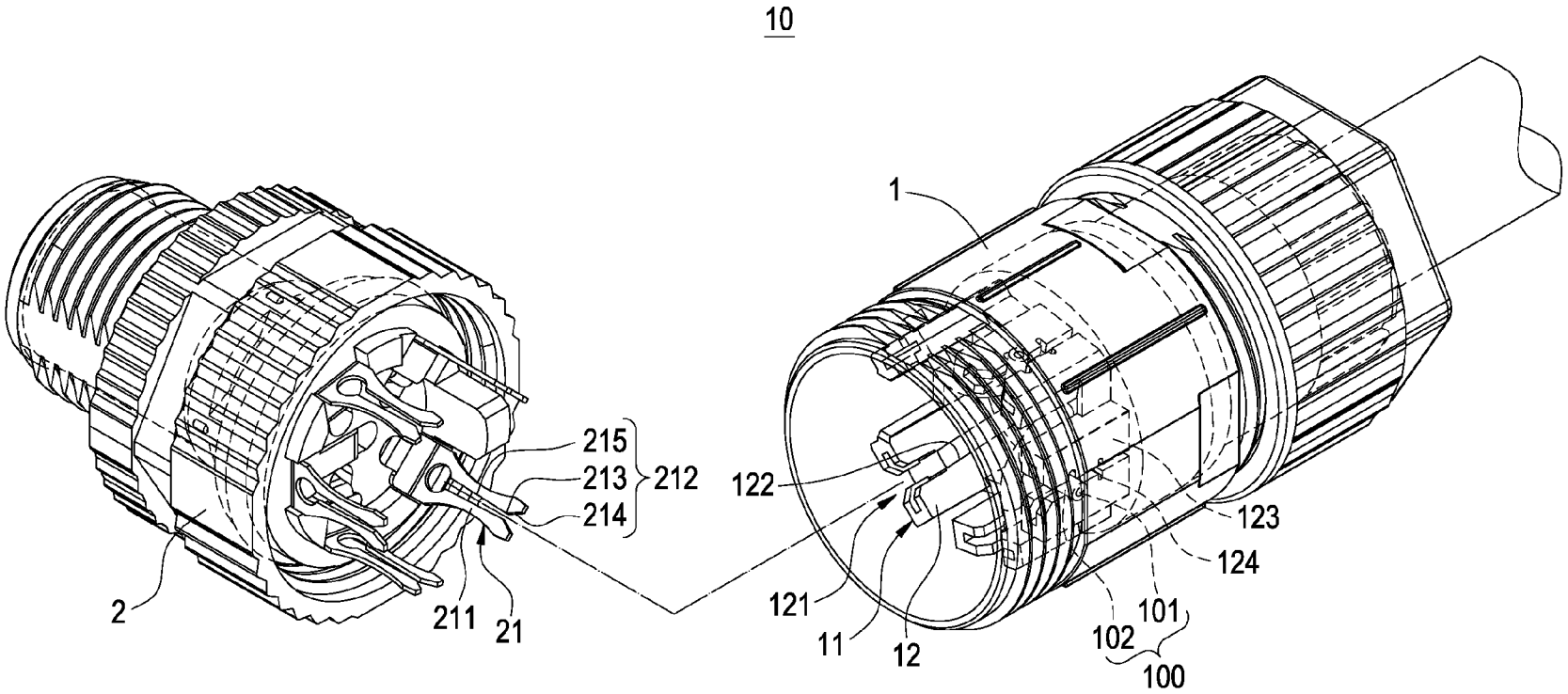
FIG. 2 is an exploded view of an electric connector of this disclosure.
Figure 3:
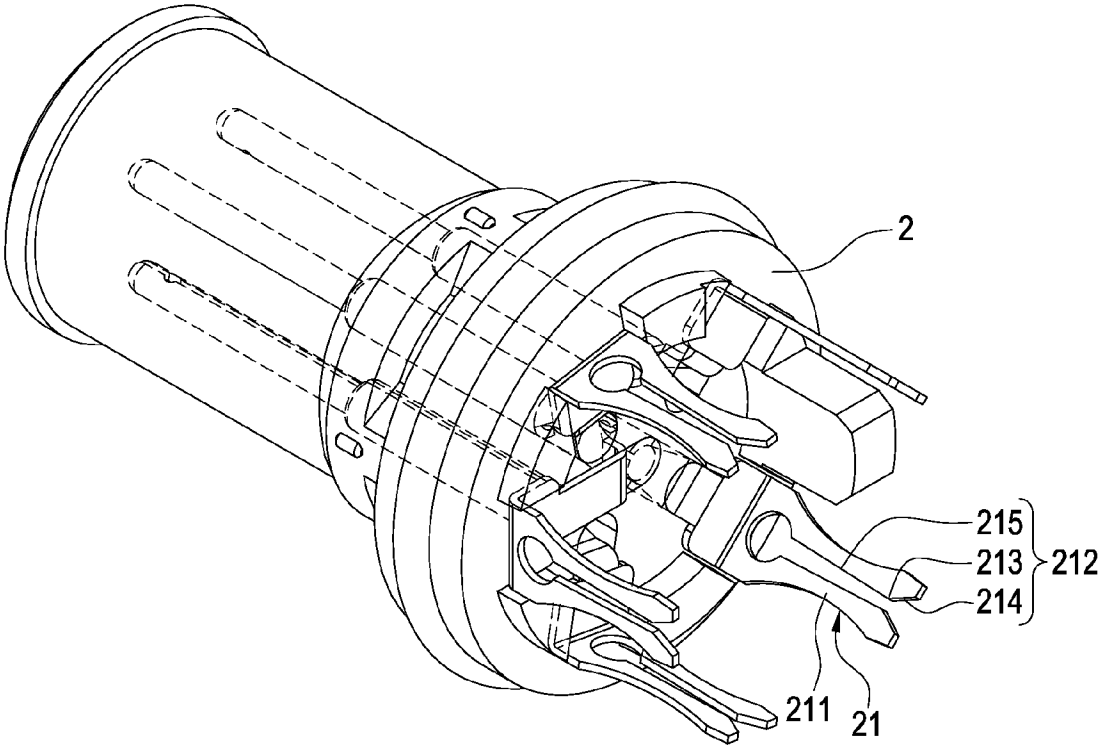
FIG. 3 is a partial perspective view of a second connector seat of this disclosure.

The technical contents of the present invention will become apparent with the detailed description of preferred embodiments accompanied with the illustration of related drawings as follows. It is noteworthy that the preferred embodiments are provided for illustrating this disclosure rather than restricting the scope of the disclosure.

With reference to FIGS. 2 to 9 for an electric connector of this disclosure, the electric connector is used for a plurality of first cables 100 and a plurality of second cables, and each first cable 100 has a core wire 101 and an insulating layer 102, and the electric connector 10 comprises a first connector seat 1 and a second connector seat 2.

In FIGS. 2, and 4 to 9, the first cables 100 are passed and coupled to the first connector seat 1, and the first connector seat 1 has a plurality of cable clamps 11, and each cable clamp 11 includes a pair of U-shaped rods 12 extended from the first connector seat 1, and each pair of U-shaped rods 12 has a pocket 121 formed on an inner side, two inner sides 122 and an outer side having two outer sides 123, and the two inner sides 122 have a plurality of cable fixing slots 124 inwardly formed on and penetrated through two outer sides 123, and the cable fixing slots 124 have a slot width h tapered in a direction towards the first connector seat 1, and each first cable 100 is selectively clamped between each pair of U-shaped rods 12 according to the wire diameter and latched to one of the cable fixing slots 124.

More specifically, the two inner sides 122 of each pair of U-shaped rods 12 are two first inclined surfaces 1221 getting closer with each other in a direction towards the first connector seat 1, and the inner side of each pair of U-shaped rods 12 has two inner bottom walls 125, and the two inner bottom walls 125 have two second inclined surfaces 1251 getting closer to each other in a direction towards the first connector seat 1, and a spacing s exists between every two second inclined surfaces 1251.

In FIGS. 2 to 3 and 7 to 9, the second connector seat 2 has a plurality of pins 21 electrically coupled to each second cable, and each pin 21 is passed and coupled to each pocket 121 and pierces through each insulating layer 102, so that each pin 21 is electrically coupled to each respective core wire 101.

Further, each pin 21 has a U-shaped insert 211, and an inner side of each U-shaped insert 211 has two blades 212, and each blade 212 has an outer protruding section 213, a first inclined edge 214 and a second inclined edge 215, and each first inclined edge 214 is formed between an open end of the blade 212 and the outer protruding section 213, and two first inclined edges 214 of each blade 212 are getting closer with each other in a direction towards the two outer protruding sections 213, and each second inclined edge 215 is formed between the bottom end of the blade 212 and the outer protruding section 213, and the two second inclined edges 215 of each blade 212 are getting closer with each other in a direction towards the two outer protruding sections 213.

In addition, the spacing s away from the first connector seat 1 is greater than the width w of the pin 21, and the spacing s adjacent to the first connector seat 1 is smaller than the width w of the pin 21, so that when each pin 21 is passed and coupled to each pocket 121, just the end section 1252 of the two second inclined surfaces 1251 stops each pin 21.

In FIGS. 5 to 9, the assembly of the electric connector 10 includes a first connector seat 1 having a plurality of cable clamps 11, and each cable clamp 11 includes a pair of U-shaped rods 12 extended from the first connector seat 1, and each pair of U-shaped rods 12 has a pocket 121 formed on an inner side, two inner sides 122, and an outer side having two outer sides 123, and the two inner sides 122 have a plurality of cable fixing slots 124 inwardly formed on and penetrated through the two outer sides 123, and the cable fixing slots 124 have a slot width h tapered in a direction towards the first connector seat 1, and each first cable 100 is clamped between each pair of U-shaped rods 12 and latched to one of the cable fixing slots 124. The second connector seat 2 has a plurality of pins 21 electrically coupled to each second cable, and each pin 21 is passed and coupled to each pocket 121 and pierces through each insulating layer 102, so that each pin 21 is electrically coupled to each respective core wire 101. Therefore, the cable fixing slot 124 bases on the corresponding and internal insertion design of the first cable 100, and arranges a plurality of cable fixing slots 124 at different positions of the cable clamp 11, and the cable fixing slots 124 fit the first cable 100 of different wire diameters, so that the first connector seat 1 fits various first cables 100 of different wire diameters, and the electric connector 10 of this disclosure has the advantages of saving cost and extending the range of installation.

Figure 4:
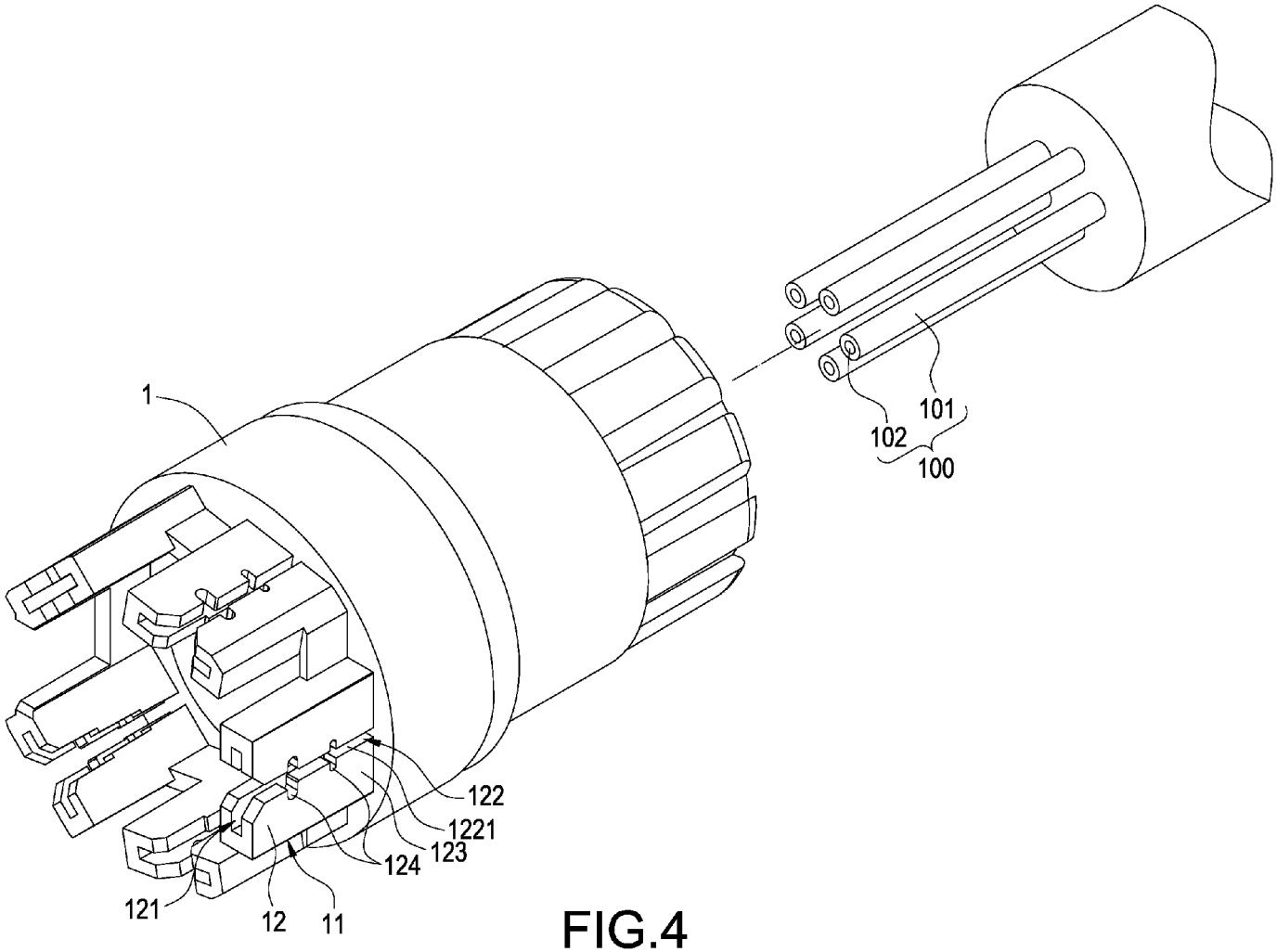
FIG. 4 is a schematic view of a first using status of an electric connector of this disclosure.
Figure 5:
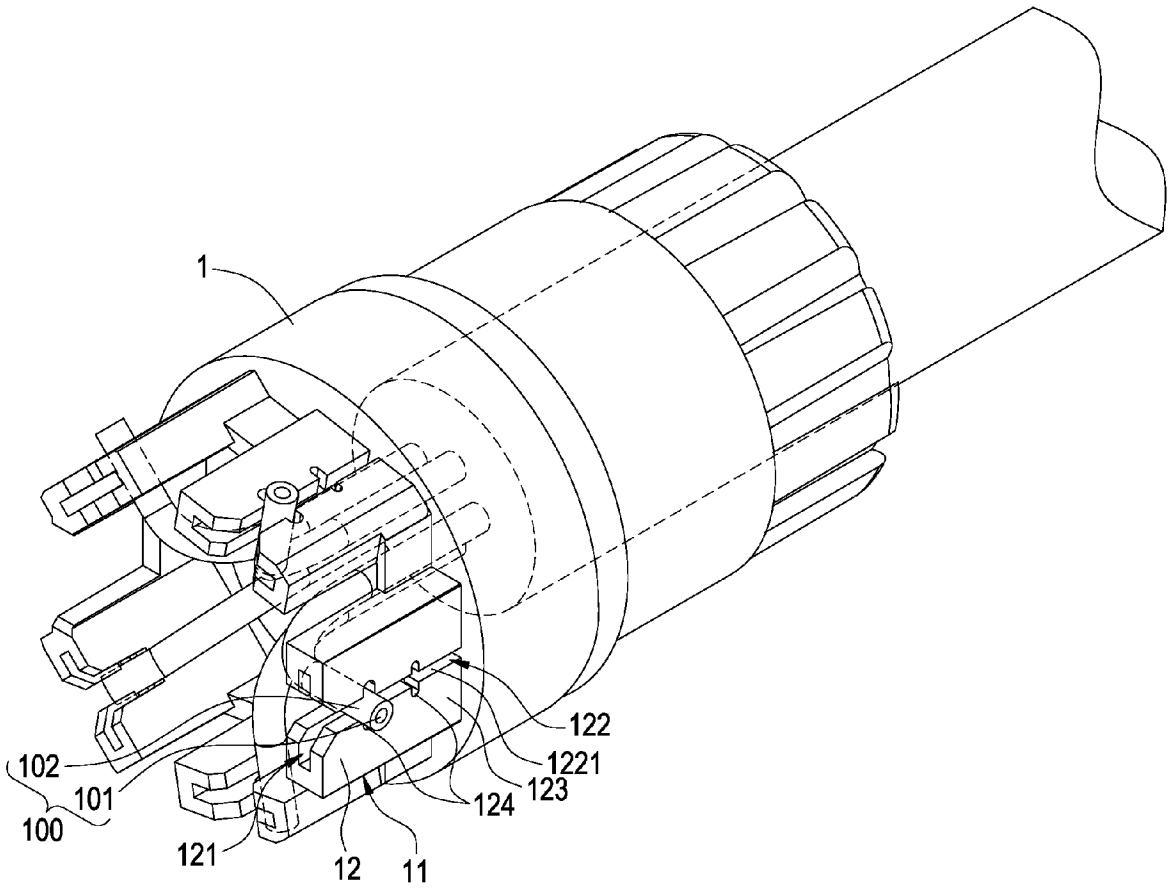
FIG. 5 is a schematic view of a second using status of an electric connector of this disclosure.
Figure 6:
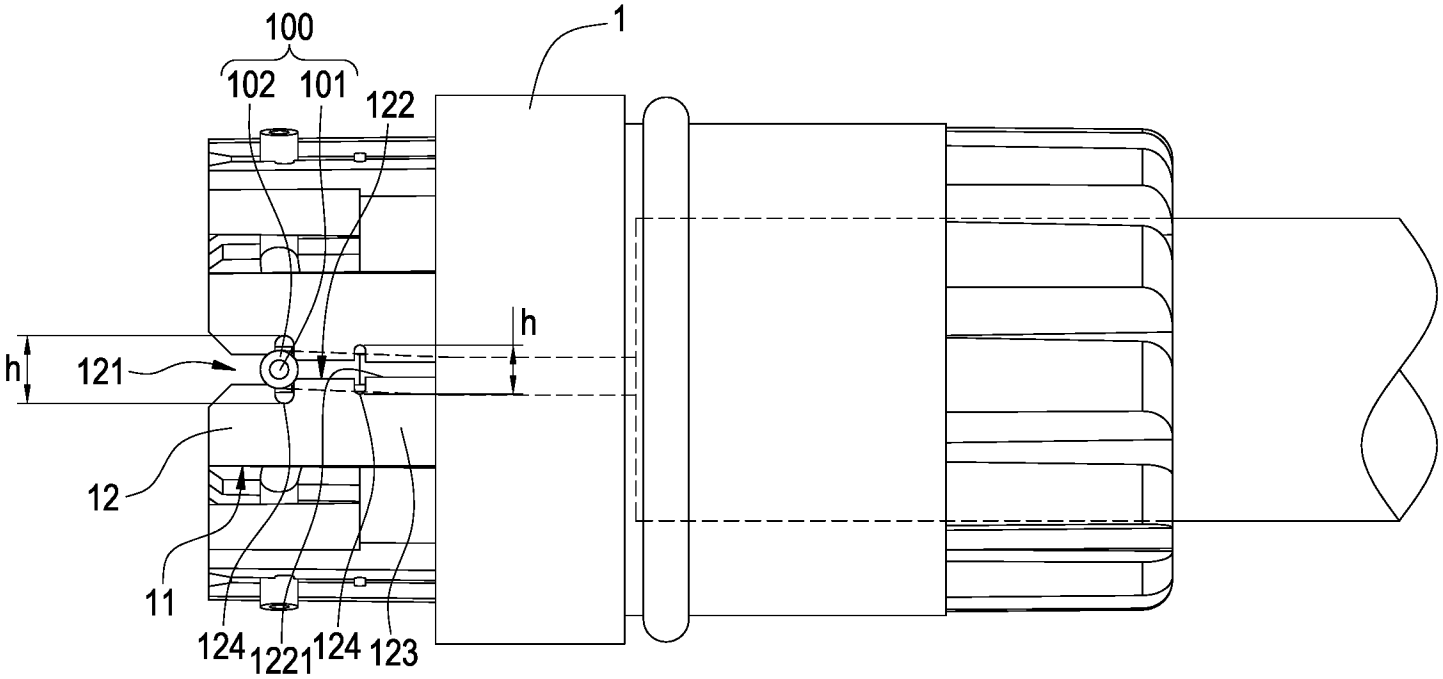
FIG. 6 is a schematic view of a third using status of an electric connector of this disclosure.
Figure 7:
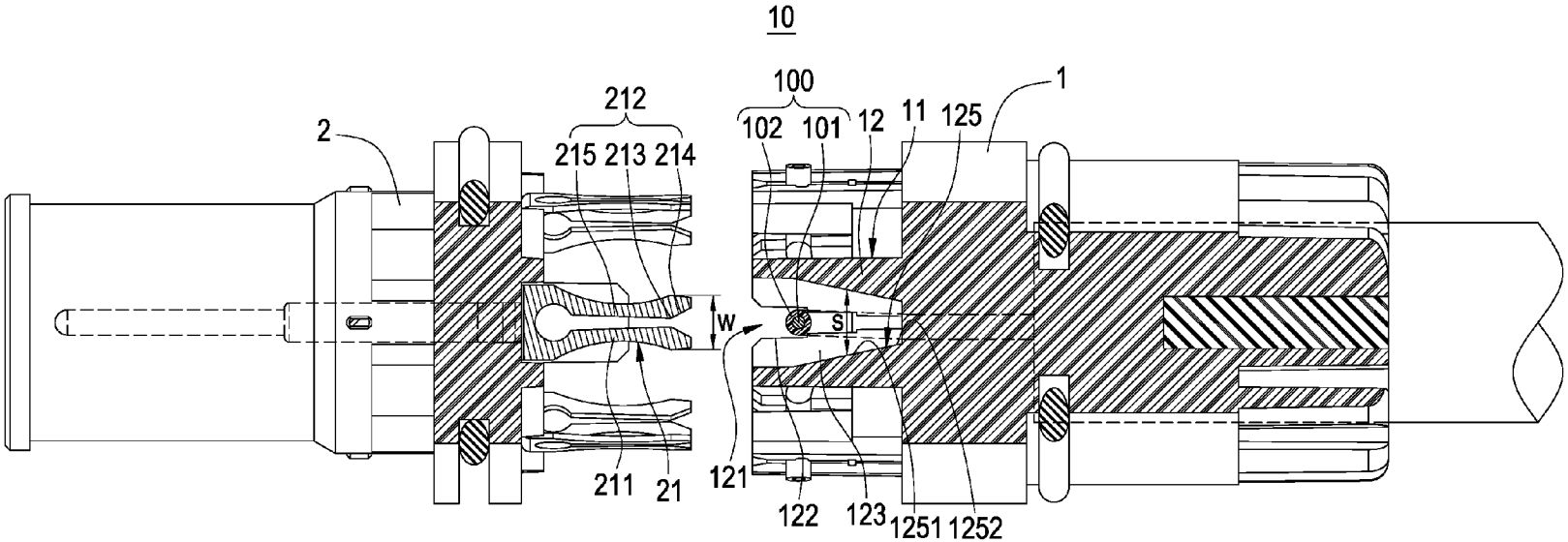
FIG. 7 is a schematic view of a fourth using status of an electric connector of this disclosure.
Figure 8:
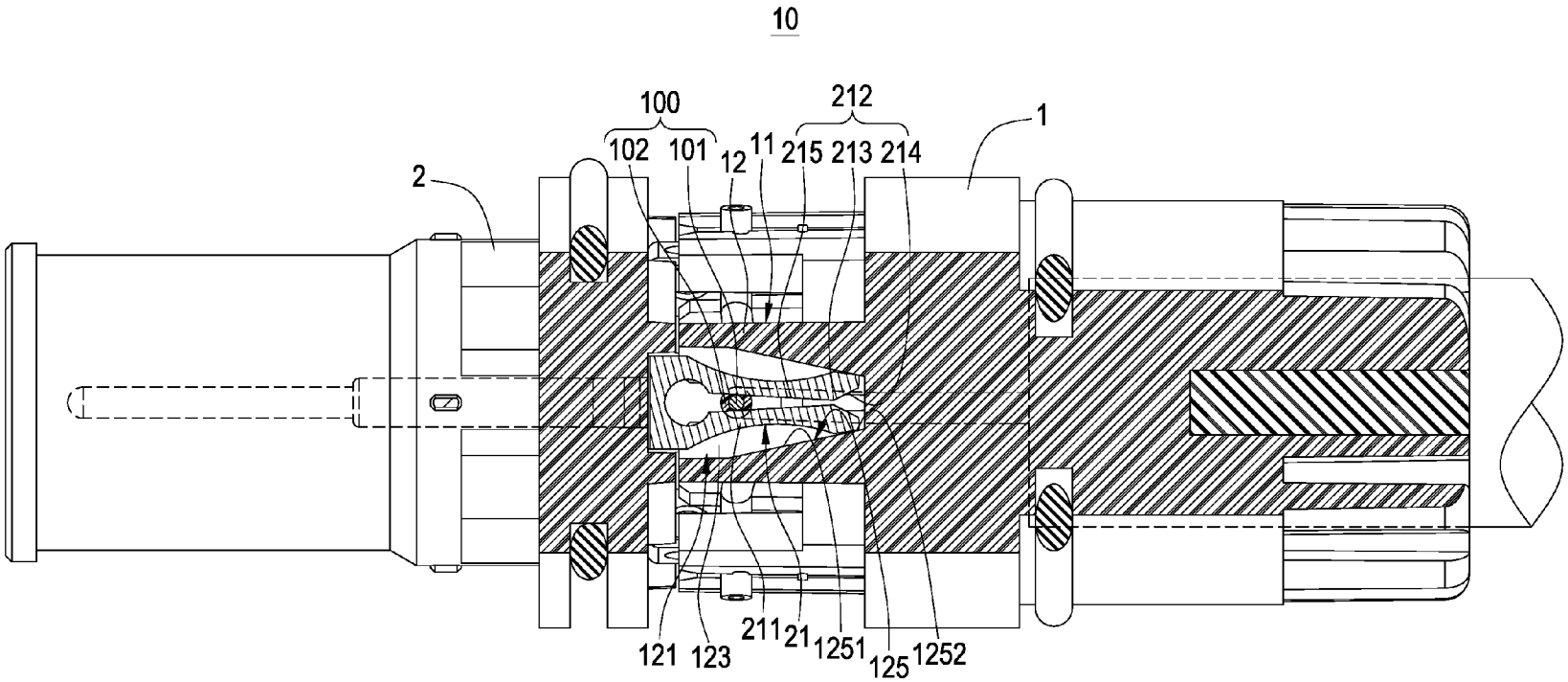
FIG. 8 is a schematic view of a fifth using status of an electric connector of this disclosure.
Figure 9:
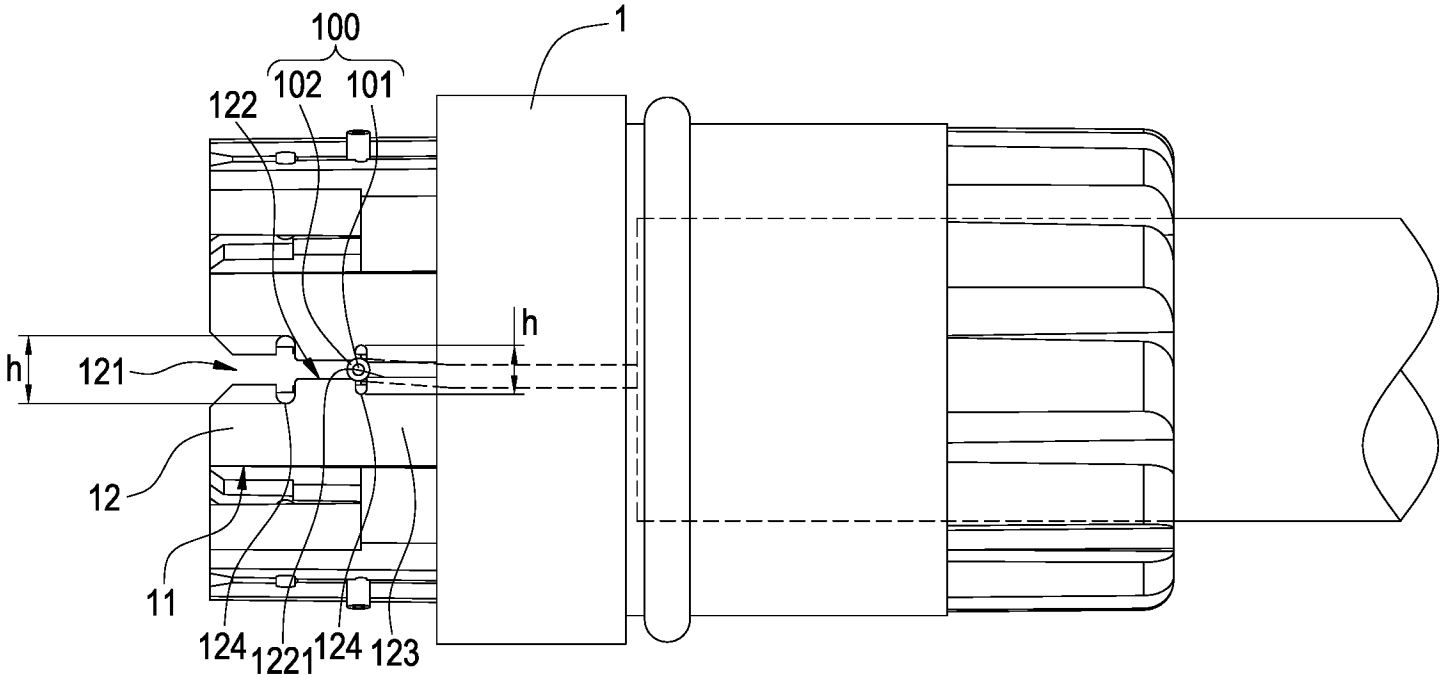
FIG. 9 is a schematic view of a sixth using status of an electric connector of this disclosure.

With reference to FIGS. 4 to 9 for different using statuses of an electric connector 10 of this disclosure, FIGS. 4, 5 and 9 show that the first cables 100 are passed and coupled into the first connector seat 1, and then each first cable 100 is bent and passed between each pair of U-shaped rods 12, so that each first cable 100 is clamped between each pair of U-shaped rods 12 and latched to one of the cable fixing slots 124. Since the two inner sides 122 of each pair of U-shaped rods 12 are two first inclined surfaces 1221 getting closer with each other in a direction towards the first connector seat 1, and the cable fixing slots 124 have a slot width h tapered towards the first connector seat 1. Therefore, the first cable 100 with a relatively greater wire diameter is latched to the top of the two first inclined surfaces 1221 and into the cable fixing slot 124 with a relatively greater slot width h (as shown in FIG. 4), and the first cable 100 with a relatively smaller wire diameter is latched to the bottom of the two first inclined surfaces 1221 and into the cable fixing slot 124 with a relatively smaller slot width h (as shown in FIG. 9), so that the cable clamp 11 of the first connector seat 1 fits various first cable 100 of different wire diameters, so as to overcome the issue of the conventional electric connector that requires opening another mold or carrying a large inventory for the cables of different wire diameters.

In FIGS. 7 and 8, when each U-shaped insert 211 is passed and coupled to each pocket 121, a spacing s exists between the two second inclined surfaces 1251 of each pair of U-shaped rods 12. Since the spacing s away from the first connector seat 1 is greater than the width w of the U-shaped insert 211, therefore the outer protruding section 213 at the front end of the U-shaped insert 211 cuts the cable 100 of a large diameter, the pocket 121 will reserve room for the U-shaped insert 211 to spread open, so as to prevent the outer protruding section 213 from damaging the structure of the core wire 101, and the outer protruding section 213 just cuts away the insulating layer 102, and the second inclined surface 1251 can be used to control the amount of deformation of the U-shaped insert 211, so as to prevent the U-shaped insert 211 from being deformed too much or having a permanent deformation by the stress.

When the U-shaped insert 211 is affected by the two second inclined surfaces 1251 getting closer with each other in a direction towards the first connector seat 1, the U-shaped insert 211 will be compressed by the lateral sides of the core wire 101, so that the contact area between the core wire 101 and the U-shaped insert 211 can be controlled to reduce the contact resistance of the product, and such design allows the electric connector 10 to control the width between the two blades 212 of the U-shaped insert 211 and the amount of deformation of the two blades 212.

In FIGS. 7 and 8, when each U-shaped insert 211 is passed and coupled to each pocket 121, a spacing s exists between the two second inclined surfaces 1251 of each pair of U-shaped rods 12. Since the spacing s away from the first connector seat 1 is greater than the width w of the U-shaped insert 211, and just the end section 1252 of the two second inclined surfaces 1251 is stopped at each U-shaped insert 211, so that the end section 1252 of the two second inclined surfaces 1251 limits the width between the two blades 212, and the width between the two blades 212 fits the wire diameter of the first cable 100 to reduce the contact resistance and prevent the two blades 212 from being deformed too much or having a plastic deformation. The deformation and stress of the two blades 212 are kept substantially equal as much as possible, so that the electric connector 10 has the advantages of fitting various first cables 100 of different wire diameters and ensuring product stability.

In FIGS. 7 and 8, the two first inclined edges 214 of each blade 212 are getting closer with each other in a direction towards the two outer protruding sections 213, so that the two blades 212 of the U-shaped insert 211 has a design wider inside and narrower outside, and the U-shaped insert 211 can fit various first cables 100 of different external diameters.

In addition, the U-shaped insert 211 has a notch formed at an open end of the blade 212, so that the two first inclined edges 214 of each blade 212 are getting closer with each other in a direction towards the two outer protruding sections 213, so as to reduce the concentration of stress. In addition, the end section 1252 of ever two second inclined surfaces 1251 can stop each pin 21. In other words, the spacing s adjacent to the first connector seat 1 is smaller than the width w of the pin 21, and thus the strength of the U-shaped insert 211 will not be affected.

In summation of the description above, the electric connector of this disclosure achieves the expected effects, overcomes the drawbacks of the prior art, and complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. An electric connector, used for a plurality of first cables (100) and a plurality of second cables, and the first cable (100) having a core wire (101) and an insulating layer (102), and the electric connector (10) comprising:

a first connector seat (1), having a plurality of cable clamps (11), each including a pair of U-shaped rods (12) extended from the first connector seat (1), and each pair of U-shaped rods (12) having a pocket (121) formed on an inner side of the pair of U-shaped rods, and both two inner sides (122) and outer side having two outer sides (123), and the two inner sides (122) jointly having a plurality of cable fixing slots (124) inwardly formed on and penetrating through the two outer sides (123), and the plurality of cable fixing slots (124) having a slot width (h) tapered in a direction towards the first connector seat (1), and each of the first cables (100) being clamped between each pair of U-shaped rods (12) and latched to one of the cable fixing slots (124); and a second connector seat (2), having a plurality of pins (21) electrically coupled to each of the second cables, and each pin (21) being passed and coupled to each pocket (121) and piercing each insulating layer (102), such that each pin (21) is electrically coupled to each respective core wire (101).

2. The electric connector of claim 1, wherein the two inner sides (122) of each pair of U-shaped rods (12) are two first inclined surfaces (1221) getting closer with each other in the direction towards the first connector seat (1).

3. The electric connector of claim 1, wherein the inner side of each pair of U-shaped rods (12) has two inner bottom walls (125), and the two inner bottom walls (125) are two second inclined surfaces (1251) getting closer with each other in the direction towards the first connector seat (1).

4. The electric connector of claim 3, wherein a spacing (s) is disposed between the two second inclined surfaces (1251), and the spacing (s) away from the first connector seat (1) is greater than the width (w) of the pin (21), and the spacing (s) adjacent to the first connector seat (1) is smaller than the width (w) of the pin (21), so that an end section (1252) of each of the two second inclined surfaces (1251) abuts each respective pin (21).

5. The electric connector of claim 1, wherein each pin (21) has a U-shaped insert (211), and an inner side of each U-shaped insert (211) has two blades (212), and each blade (212) has an outer protruding section (213), a first inclined edge (214) and a second inclined edge (215), and each first inclined edge (214) is formed between an open end of the blade (212) and the outer protruding section (213), and each second inclined edge (215) is formed between the bottom end of the blade (212) and the outer protruding section (213).

6. The electric connector of claim 5, wherein the two first inclined edges (214) of each blade (212) are getting closer with each other in the direction towards the two outer protruding sections (213).

7. The electric connector of claim 5, wherein the two second inclined edges (215) of each blade (212) are getting closer with each other in the direction towards the two outer protruding sections (213).

* * * * *